US005535775A

United States Patent [19]

Blaine

[11] Patent Number: 5,535,775

[45] Date of Patent: Jul. 16, 1996

[54] MOBILE PUMP AND HOSE ASSEMBLY DEPLOYMENT, DECONTAMINATION, STORAGE AND TRANSPORT SYSTEM

[76] Inventor: Richard C. Blaine, 21024 Chateau Dr., Saratoga, Calif. 95070

[21] Appl. No.: 344,362

[22] Filed: Nov. 23, 1994

[51] Int. Cl.[6] ..... B65H 75/34

[52] U.S. Cl. ..... 137/355.17; 137/355.2; 137/355.26; 242/388.7; 242/395; 242/399.2

[58] Field of Search ..... 137/899.3, 355.17, 137/565, 355.26, 355.16, 355.2, 351, 563, 238; 242/388.6, 388.7, 395, 399, 399.1, 399.2

[56] References Cited

U.S. PATENT DOCUMENTS

| | | | |
|---|---|---|---|
| Re. 27,874 | 1/1974 | Fisco, Jr. | 137/340 |
| 2,071,731 | 2/1937 | Craig et al. | 137/355.26 |
| 2,805,100 | 9/1957 | Shaver | 242/395 |
| 2,964,258, | 12/1960 | Kutil | 242/399.2 |
| 3,325,118 | 6/1967 | Hall | 242/399.1 |
| 3,810,487 | 5/1974 | Cable et al. | 137/351 |
| 4,062,493 | 12/1977 | Suggs | 242/395 |
| 4,155,518 | 5/1979 | Small | 242/388.7 |
| 4,228,967 | 10/1980 | Woodruff | 242/399.1 |
| 4,643,370 | 8/1987 | Pierce | 242/388.6 |
| 4,784,166 | 11/1988 | Brager et al. | 134/50 |
| 5,211,203 | 5/1993 | Vollweiler et al. | 137/355 |
| 5,323,800 | 6/1994 | Vollweiler et al. | 137/240 |

*Primary Examiner*—A. Michael Chambers
*Attorney, Agent, or Firm*—Michael J. Hughes; Bradley T. Sako

[57] ABSTRACT

A mobile pump and hose assembly deployment, decontamination, storage, and transport system (DDST) (10) having a support frame assembly (14) supporting two boom assemblies (16) and a take up reel assembly (18). Each boom assembly (16) is segmented, hinged structure that collapses from a deploy position to a compact store position and includes a primary reel (20) for storing and deploying a pump (144), and pump-to-hose adapter (144), and a pump hose (138) into a well (149). A plumbing tree (126) is situated within each primary reel (20) and provides a fluid and electrical connection to the pump (144). The take up reel assembly (18) is adapted to receive the pump (144), pump-to-hose adapter (143), and rotates to receive the pump hose (138). As the pump hose (138) is wound onto the take up reel assembly (18) from the primary reel (20) is can be passed through an external hose cleaning apparatus (194). The take up reel assembly (18) is a pivotal structure, allowing the pump (144) and pump-to-hose adapter (143) to be positioned in a cleaning portion (166). A recirculation cleaning loop can be formed by first filling the cleaning portion (166) with cleaning fluid (234) and connecting a recirculation hose (232) between the plumbing tree (126) and the cleaning portion (166). The cleaning fluid (234) is pumped by the pump (144) through the pump-to-hose adapter (143), the pump hose (138), the plumbing tree (126), the recirculation hose (232) and back into the cleaning portion (166). A containment sink (22) is disposed beneath the take up reel assembly (18) to collect cleaning fluid. The entire system (10) is covered by an enclosure assembly (24) to prevent contamination during transport, and unauthorized use.

22 Claims, 10 Drawing Sheets

MOBILE PUMP AND HOSE ASSEMBLY DEPLOYMENT, DECONTAMINATION, STORAGE AND TRANSPORT SYSTEM

TECHNICAL FIELD

The present invention relates generally to water sampling systems, and more particularly to mobile ground water sampling systems for detecting contamination in ground water.

BACKGROUND ART

Potable water is an essential requirement for all human beings, and ground water remains an essential source of drinkable water. Unfortunately, the increasing world population and continued strides in industrialization have resulted in numerous waste products that embody tangible threats to ground water supplies. In order to detect such undesirable products, ground water is routinely tested for a number of contaminants that are known to be harmful to mankind. Although such tests are extremely accurate, they directly depend upon the manner in which the water sample is acquired. To avoid erroneous results, it is essential that no extraneous contaminants be introduced into the sample taken. Thus, any ground water sampling system must provide both a "clean" (i.e. contaminant free) sampling apparatus for taking a water sample, and a cleaning apparatus for cleaning the sampling apparatus.

Certain factors also contribute to the efficiency of water sampling systems. Due to the wide spread, and sometimes remote locations of monitoring wells, it advantageous for water sampling systems to be easily transportable. Overly heavy or bulky systems can limit the areas in which sampling can be performed and increase the cost and effort needed. A degree of simplicity in design is also desirable as overly complex systems can require a great amount of cleaning, repair, and maintenance, and can also require operators to undergo special training programs to learn how to properly operate the apparatus. To reduce sampling time it is also desirable to have a system wherein once the components are cleaned, they can be stored, and remain clean until required at a later time.

An important aspect of ground water sampling procedures is the initial evacuation of the sampling well. Prior to lowering a sampling device into the well, the well is evacuated by a pump. Once the well is evacuated more water to flows back into the well. It is this water that is sampled as it is considered a more accurate representation of the ground water at that location. Both prior to evacuation, and after evacuation, it is desirable to have clean equipment, to ensure accurate results.

While pumps have been produced which conform to administrative requirements for materials acceptable for use in ground water monitoring, materials used for hoses remains a problem. Approved years ago for ground water monitoring, polytetrafiouroethylene (TEFLON®) is widely available, but expensive, and subject to undesirable adsorption and absorption characteristics. Alternate hose materials are often difficult to decontaminate.

A number of systems are present in the prior art aimed at ground water sampling, general equipment cleaning, and equipment storage. U.S. Pat. Nos. 5,211,203 and 5,323,800 both issued to Vollweiler et al. on May 18, 1993 and Jun. 28, 1994, respectively, present a portable ground water testing assembly. The assembly of the Vollweiler et al. patents provides a unique, self contained structure having a hydraulic system for driving a boom, and a number of hydraulically driven spools mounted on the boom. The boom includes a spool end for mounting a storage spool and a sheave end for mounting a sheave. A hose and an associated pump are wound onto the storage spool. When the Vollweiler et al. apparatus is in sampling operation, the pump and a portion of the hose are unwound from the spool and onto the sheave. The boom is pivoted so that the sheave end is positioned above a well and the storage spool is unwound, allowing the pump and hose to descend into the well. The apparatus of Vollweiler et al. is complex however, requiring a hydraulic pump and a control system for managing the many functions of the boom. This results in increased maintenance and repair costs, and increases the opportunity for generating contaminants due to the hydraulic fluid and numerous lubricants requires. In addition, the boom itself is a heavy structure increasing the overall weight of the system. The assembly illustrated in Vollweiler et al. is also an "open air" system, that is, it lacks a protective enclosure. The absence of protective enclosures greatly increases the probability that all system components, including those which enter the ground water, will collect unwanted contamination while the system is being transported from common airborne contaminants, such as mists, vapors, gases, fumes and particulate matter of all types, that are present in especially heavy concentrations along roads and highways.

Removing contaminants associated with transportation is complicated in present art systems, such as the assembly illustrated in Vollweiler et al., by the arrangement in which the hose is cleaned automatically as it is drawn out of the well and wound onto the reel. This arrangement assumes that a single pass through the spray box will completely decontaminate the hose. Even though the hose can be given a second pass through the spray box as the pump and hose are deployed into the next ground water monitoring well, this only extends the cleaning to a maximum of two passes of the hose through the spray box. This limitation places significant demands on the ability of the spray box to remove all possible contaminants in two passes. In the case of contamination which collects on the components during transport, cleaning is limited to a single pass which occurs as the hose is unwound from the reel, passed through the spray box and lowered into the next well to be monitored. Thus, the decontamination process of Vollweiler et al. is largely dependent on the availability of a ground water well into which the pump and hose assembly can be lowered. Moreover, the full length of the hose will not be cleaned if the available wells are not deep enough to receive all the hose from the reel or have some other characteristics which make their use inadvisable. This means that recently cleaned sections of hose will be wound onto the reel with hose which has not been cleaned.

A truck mounted cleaning system is set forth in U.S. Pat. No. Re: 27,874 reissued to Fisco, Jr., dated Jan. 8, 1974. The Fisco, Jr. patent illustrates a shroud apparatus for coveting a sewer cleaning system that is primarily aimed at preventing the components of the system from freezing in cold weather. While the Fisco, Jr. apparatus includes an easy opening rear closure member, the apparatus is not adapted for keeping the components within contaminant free.

A truck washing system employing a hose wound reel is illustrated in U.S. Pat. No. 4,784,166 issued to Brager et al. on Nov. 15, 1988. The truck washing system includes a hydraulic circuit for providing movement to the system, resulting in a self-contained, compact unit. While the hydraulic circuit operates with water as a fluid, eliminating potential contaminants presented by petroleum based fluids and lubricants, the apparatus requires a pressured source of water for the hydraulic circuit. In addition, the washing system provides no apparatus for cleaning the hose itself.

None of the prior art addresses the need for a ground water sampling system that provides a easily cleaned water sampling apparatus that can be securely stored, is easily maintained, and that is also easy to operate.

SUMMARY OF THE INVENTION

Accordingly, it is an object of the present invention to provide a mobile pump and hose assembly deployment, decontamination, storage, and transport system of only moderate weight.

It is another object of the present invention to provide a mobile pump and hose assembly deployment, decontamination, storage, and transport system that is easy to use.

It is yet another object of the present invention to provide a mobile pump and hose assembly deployment, decontamination, storage, and transport system that can be transported without subjecting the water sampling components to contamination.

Yet another object of the present invention is to provide a mobile pump and hose assembly deployment, decontamination, storage, and transport system that is easy to maintain and repair.

Another object of the present invention is provide a mobile pump and hose assembly deployment, decontamination, storage, and transport system that can be thoroughly decontaminated after use.

Still another object of the present invention is to provide a mobile pump and hose assembly deployment, decontamination, storage, and transport system having components that do not provide a source of additional contamination.

Yet another object of the present invention is to provide a mobile pump and hose assembly deployment, decontamination, storage, and transport system that allows for a number of different versatile cleaning procedures and equipment.

Another object of the present invention is to provide a mobile pump and hose assembly deployment, decontamination, storage, and transport system that contains all splashed and spilled evacuated ground water.

It is still another object of the present invention to provide a mobile pump and hose assembly deployment, decontamination, storage, and transport system that contains all splashed and spilled evacuated cleaning fluids used to clean the components of the system.

Yet another object of the present invention is to provide a mobile pump and hose assembly deployment, decontamination, storage, and transport system that does not cause undue fatigue when operated.

Briefly, the preferred embodiment of the present invention is a mobile pump and hose assembly deployment, decontamination, storage, and transport system that includes a mounting frame attached to rear of a pick up truck. The mounting frame provides a mounting face parallel to the rear of the pick up truck and stretches between a first comer edge and a second comer edge. A boom assembly is attached to each corner edge by a vertically disposed boom hinge. Each boom includes an inside boom segment and an outside boom segment joined by a vertical segment hinge. A primary reel is mounted on each outside boom segment, and each primary reel includes a hose, and a pump, which is joined to the hose by a pump-to-hose adapter. The segment hinge and boom hinge allow each boom assembly to be pivoted between a stored position and an extended position. The stored position is characterized by the inside boom segment being pivoted about the boom hinge so as to be adjacent to the mounting face, and the outside boom segment being pivoted about the segment hinge so as to be adjacent to the inside boom segment. The extended position is characterized by the inside boom segment and outside boom segment being pivoted outward until the mounted primary reel is positioned over a well to be sampled.

The pump, pump to hose adapter, and hose are inserted into the well. Water and electrical connections are made by attaching an effluent hose and an electrical supply cord to a water and an electrical connection on a plumbing tree that is set within the primary reel. The pump can then be turned on by switching on a remote electrical switch. Ground water is pumped through the pump assembly, up the hose, through the plumbing tree, and into the effluent hose which leads to a storage tank.

Centrally disposed within the mounting face, between the booms, is a tiltable take up reel. In the preferred embodiment, the take up reel includes a take up winding surface that has a holster tube and two hose bending channels set therein. The winding surface and the holster tube are perpendicular to the mounting face. The take up reel can be tilted about a tilt axis, which is disposed parallel to the mounting face. In order to clean the pump, the pump-to-hose adapter, and hose after use, the holster tube receives the pump and pump-to-hose adapter with a portion of the hose being routed into one of the hose bend channels. Most of the remainder of the hose can be off-loaded from the primary reel by winding the hose onto the take up reel. A sink is provided below the primary reels and take up reel to collect cleaning fluids.

The preferred embodiment of the present invention incorporates a recirculating cleaning loop for cleaning all internal surfaces of the pump, pump-to-hose adapter, hose, and plumbing tree. The recirculating cleaning loop is formed by the pump, adapter, hose, plumbing tree, a supplemental hose, and the holster tube. The pump and pump-to-hose adapter, which remain attached to the end of the hose, are inserted into the holster tube and the take up reel is tilted so that the holster tube is vertically disposed. A supplementary hose is connected at one end to the plumbing tree and at the other end to the holster tube. The electrical supply cord is also connected to an appropriate connector on the plumbing tree. Cleaning fluid is introduced into the holster tube, the pump is turned on, and the cleaning fluid recirculates from the holster tube through the pump, the pump-to-hose adapter, the hose, the plumbing tree, the supplementary hose, and then back into the holster tube.

In the preferred embodiment, the various components of the ground water sampling system are protected from contamination during transportation by a rear hatch assembly that includes a fold down roof panel having a rear door, and two side panels.

An advantage of the present invention is that it provides a mobile pump and hose assembly deployment, decontamination, storage, and transport system with a recirculating cleaning loop for cleaning the internal surfaces of the system components.

Yet another advantage of the present invention is that it provides a mobile pump and hose assembly deployment, decontamination, storage, and transport system that can be easily inspected.

Still another advantage of the present invention is that it provides a mobile pump and hose assembly deployment, decontamination, storage, and transport system that can be decontaminated in any location.

Yet another advantage of the present invention is that it provides a mobile pump and hose assembly deployment, decontamination, storage, and transport system that allows for concentrated cleaning of any part of the system.

Another advantage of the present invention is that it provides a mobile pump and hose assembly deployment, decontamination, storage, and transport system that does not use potentially contaminating lubricants or hydraulic fluids.

Yet another advantage of the present invention is that it provides a mobile pump and hose assembly deployment, decontamination, storage, and transport system that can be transported without exposing the components to contamination.

Still another advantage of the present invention is that it provides a mobile pump and hose assembly deployment, decontamination, storage, and transport system that avoids using potentially dangerous components.

These and other objects and advantages of the present invention will become clear to those skilled in the an in view of the description of the best presently known mode of carrying out the invention and the industrial applicability of the preferred embodiment as described herein and as illustrated in the several figures of the drawing.

BEST MODE FOR CARRYING OUT THE INVENTION

Figure 1:
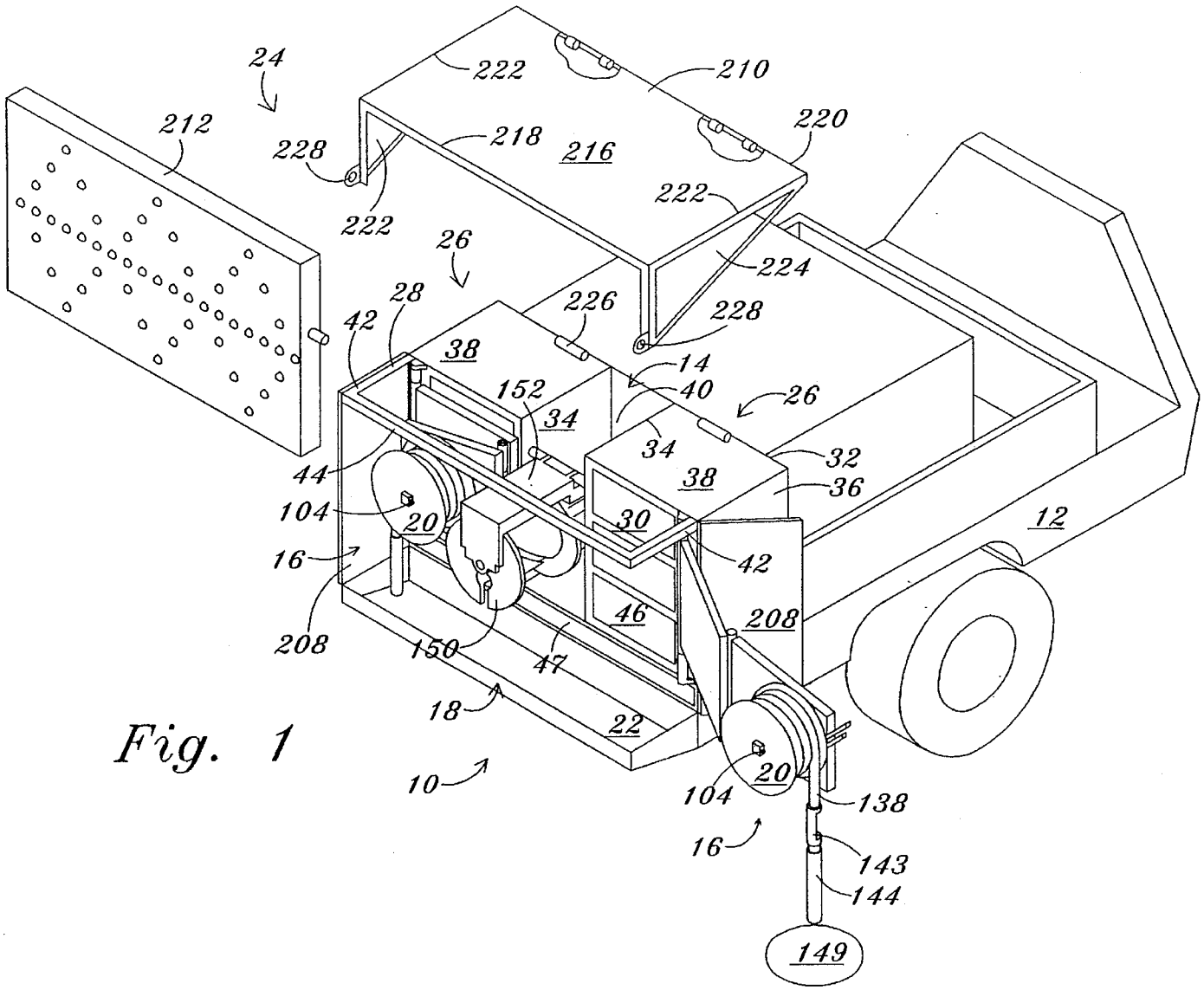
FIG. 1 is an exploded, isometric view of the preferred embodiment of the present invention with the left boom in the "store" position, and the right boom in the "deploy" position.

The best presently known mode for carrying out the present invention is a mobile pump and hose assembly deployment, decontamination, storage, and transport system primarily aimed at obtaining ground water samples from ground water wells. The preferred embodiment of the present invention is illustrated in FIG. 1 and designated by the general reference character 10. As set forth in FIG. 1, the mobile pump and hose assembly deployment, decontamination, storage, and transport system (DDST) 10 is situated within the bed of a pick up truck 12 and is shown to include a support frame assembly 14, two boom assemblies 16, and a centrally disposed take up reel assembly 18. One primary reel 20 is positioned on each boom assembly 16. Positioned directly below the take up reel assembly 18 is a containment sink 22. To provide protection to the many components of the preferred embodiment, an enclosure assembly 24 is also provided.

The preferred embodiment 10 is designed to be a mobile system. While the system 10 is illustrated as being deployed in the bed 12 of pick up truck, it is noted that the system is also adaptable for use in other vehicles, including towed trailers.

Referring now to FIG. 1, the support frame assembly 14 is shown to include two cabinet assemblies 26 and an outwardly projecting support beam 28. The cabinet assemblies 26 have the general shape of a rectangular solid, and include a front cabinet face 30, a rear cabinet face 32, an inside cabinet face 34, an outside cabinet face 36, a cabinet top 38 and a cabinet bottom (not shown). The cabinet assemblies are separated by a mounting space 40 situated between the inside cabinet faces 34. Each cabinet assembly 26 is securely mounted to the truck bed 12 to provide a firm anchoring point for other structures. As illustrated in FIG. 1, each cabinet assembly 26 also includes multiple storage enclosures such as the storage drawers 46 shown here. The drawers 46 are set vertically in the cabinet assembly 26 and are designed to be pulled out from the front cabinet face 30. The drawers 46 provide a convenient storage location for items commonly used by the operators of the preferred embodiment. Another storage area 47 is located below the take up reel assembly 18 and below the two cabinet assemblies 26 and above the containment sink 22. This storage area 47 is intended for a variety of different devices, and may extend inward under the cabinets 26 any where from just a few inches, for smaller equipment, on up to the entire length of the truck bed 12 for longer pieces of equipment. The storage area 47 may be further divided into smaller areas to provide a number of sealed, individual storage locations The support beam 28 is a rigid, unitary structure that includes two longitudinal segments 42 and one lateral segment 44. One longitudinal segment 42 extends from each cabinet assembly 26 at a comen formed by the front cabinet face 30, the outside cabinet face 36, and the cabinet top 38. Each longitudinal segment 42 projects outward from, and perpendicular to, the front cabinet face 30, terminating in the lateral segment 44. The lateral segment 44 joins the two longitudinal segments 42 and is disposed frontward of, and parallel to, the front cabinet faces 30.

Figure 2:
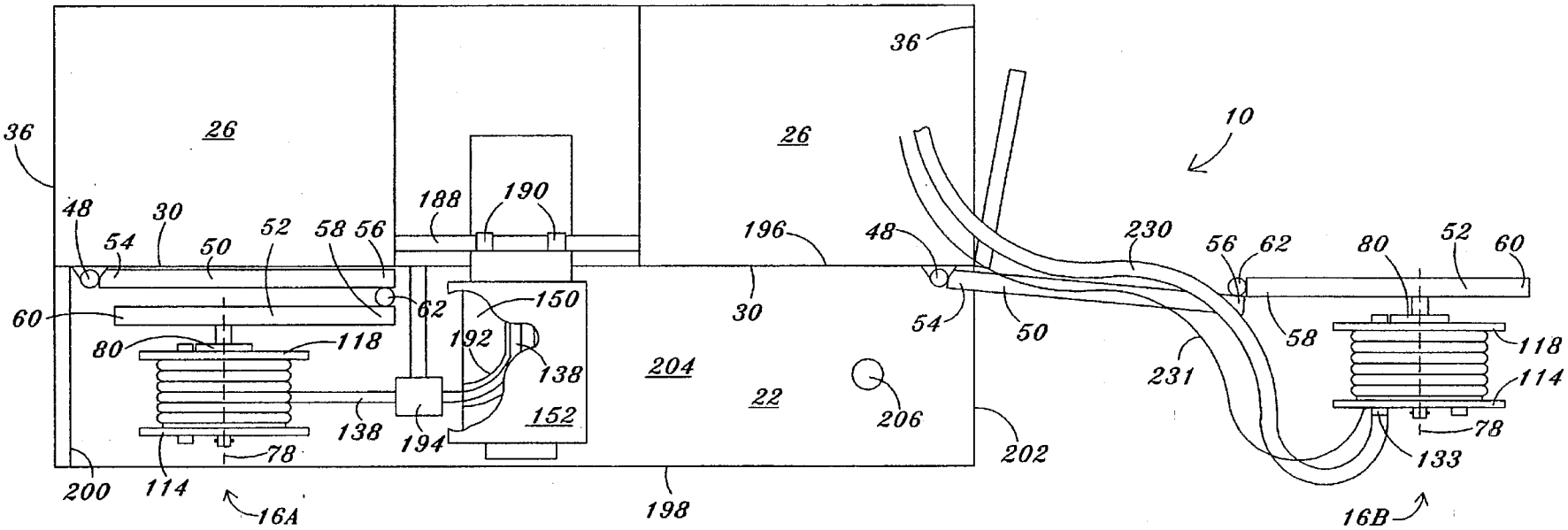
FIG. 2 is top plan view of the preferred embodiment of the present invention.

As best illustrated in FIGS. 1 and 2, in the preferred embodiment 10, one boom assembly 16 is pivotally attached to the front cabinet face 30 of each cabinet assembly 26 by a boom hinge 48. Both boom hinges 48 are vertically disposed hinges positioned inward from the outside cabinet faces 36. The boom hinges 48 enable the boom assemblies 16 to pivot about a vertical axis from the front cabinet faces 30. By being positioned close the outside cabinet faces 36, the boom hinges 48 allow maximum pivoting range for the boom assemblies 16. Each boom assembly 16 includes an inside segment 50 and an outside segment 52. The inside segment 50 is a generally flat, rigid member, having an attachment end 54, and an inside pivot end 56. The outside segment 52 is also a flat rigid member, and includes an outside pivot end 58 and a distal segment end 60. As is best illustrated in the top view of FIG. 2, the inside pivot end 56 of the inside segment 50, and the outside pivot 58 of the outside segment 52, are joined by a vertically disposed segment hinge 62. The segment hinge 62 enables the outside segment 52 to pivot about a vertical axis with respect to the inside segment 50. The combination of the boom hinge 48 and segment hinge 62 enable each boom assembly 16 to be stored in a compact "store" position. To illustrate the "store" position, the boom assemblies 16 of the preferred embodiment 10 can be further defined according to position, as a left boom assembly 16A and a right boom assembly 16B. The left boom assembly 16A is shown pivoted into the "store" position. In the "store" position the inside segment 50 is adjacent and roughly parallel to the outside cabinet face 36 to which it is attached. At the same time, the outside segment 52 is pivoted back toward the inside segment 50 so as to be adjacent to, and roughly parallel with the inside segment 50.

Figure 3:
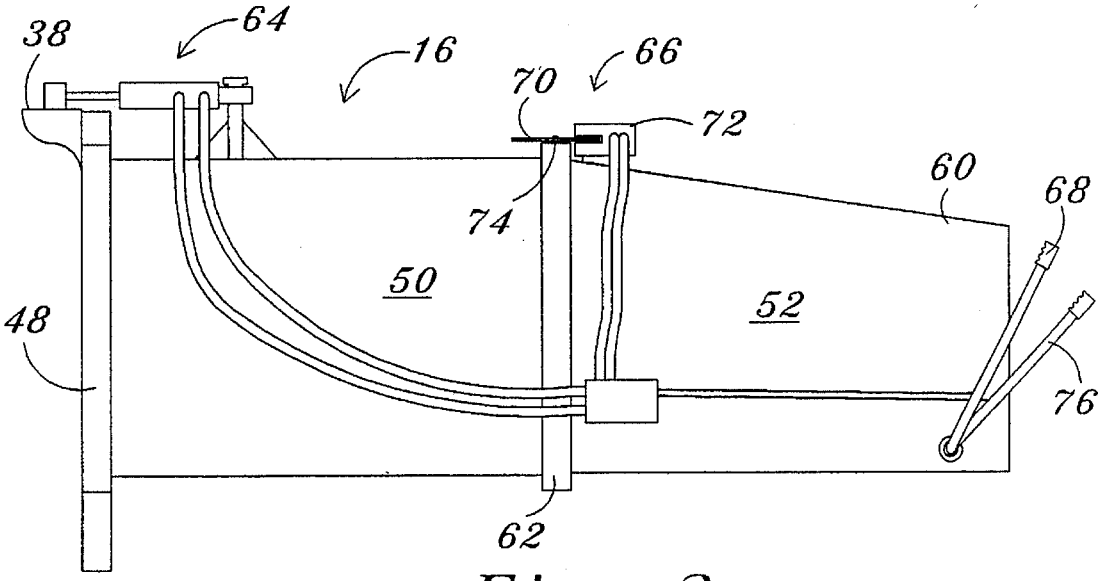
FIG. 3 is a side plan view of the boom assembly of the preferred embodiment.

While the outside and inside segments (52 and 50) of each boom assembly 16 are free to pivot about the boom hinge 48 and the segment hinge 62, the boom assembly 16 is also capable of locking either the boom hinge 48 or the segment hinge 62 at any pivot orientation. As illustrated in FIG. 3, the boom hinge 48 has an associated boom hinge locking mechanism 64, and the segment hinge 62 has an associated segment hinge locking mechanism 66. In the preferred embodiment 10, the boom hinge locking mechanism 66 is a hydraulic cylinder attached at one end to the cabinet top 38 and at an opposing end to the inside segment 50. The hydraulic cylinder is conventional in all aspects except for the type of hydraulic fluid utilized. To minimize any potential contaminating effects from petroleum base fluids, isopropyl alcohol is used in the preferred embodiment 10. As illustrated in FIG. 3, the boom hinge locking mechanism 66 is controlled by a boom hinge control lever 68. The boom hinge control lever 68 is pre-tensioned to force the boom hinge locking mechanism 64 into the "locked" position (i.e. no hydraulic fluid is allowed to pass between chambers in the hydraulic cylinder). Thus, in order to pivot the boom assembly 16 about the boom hinge 48, the boom hinge control lever 68 must be activated to take the boom hinge locking mechanism 64 out of the locked position, while at the same time, the boom assembly 16 is manually pivoted to the desired position. When the boom hinge control lever 68 is released, the boom hinge 48 returns to the locked position. The segment hinge locking mechanism 66 operates in an analogous manner to the boom hinge locking mechanism 64. Unlike the boom hinge locking mechanism 64, however, the segment hinge locking mechanism 66 of the preferred embodiment 10, is a caliper disk brake that includes a disk 70 and a caliper assembly 72. As illustrated in FIG. 3, the disk 70 is fixedly attached to a hinge top surface 74 of the segment hinge 62, and the caliper assembly 72 is attached to the outside segment 52 and positioned to engage the disk 70. Because the disk 70 is secured to the segment hinge 62, and the caliper assembly 72 attached to the outside segment 52, as the outside segment 52 pivots about the segment hinge 62, the caliper assembly 72 radially tracks around the disk 70. This arrangement results in a structure wherein, regardless of the pivotal position of the outside segment 52, the caliper assembly 72 can engage the disk 70. Like the boom hinge control lever 68, the segment hinge locking mechanism 66 is controlled by a segment hinge control lever 76 that is pretensioned in the "locked" position (i.e. the caliper assembly 72 engaging the disk 70). Thus, to allow the segment hinge 62 to pivot freely, the segment hinge control lever 76 must be activated to release the caliper assembly 72 from engaging the disk 70. For ease of use, the boom hinge control lever 68 and the segment hinge control lever 76 are positioned at the distal segment end 60 of the outside segment 52. Both control levers (68 and 76) are designed to be pulled down to release the associated hinge (48 and 62).

Figure 4:
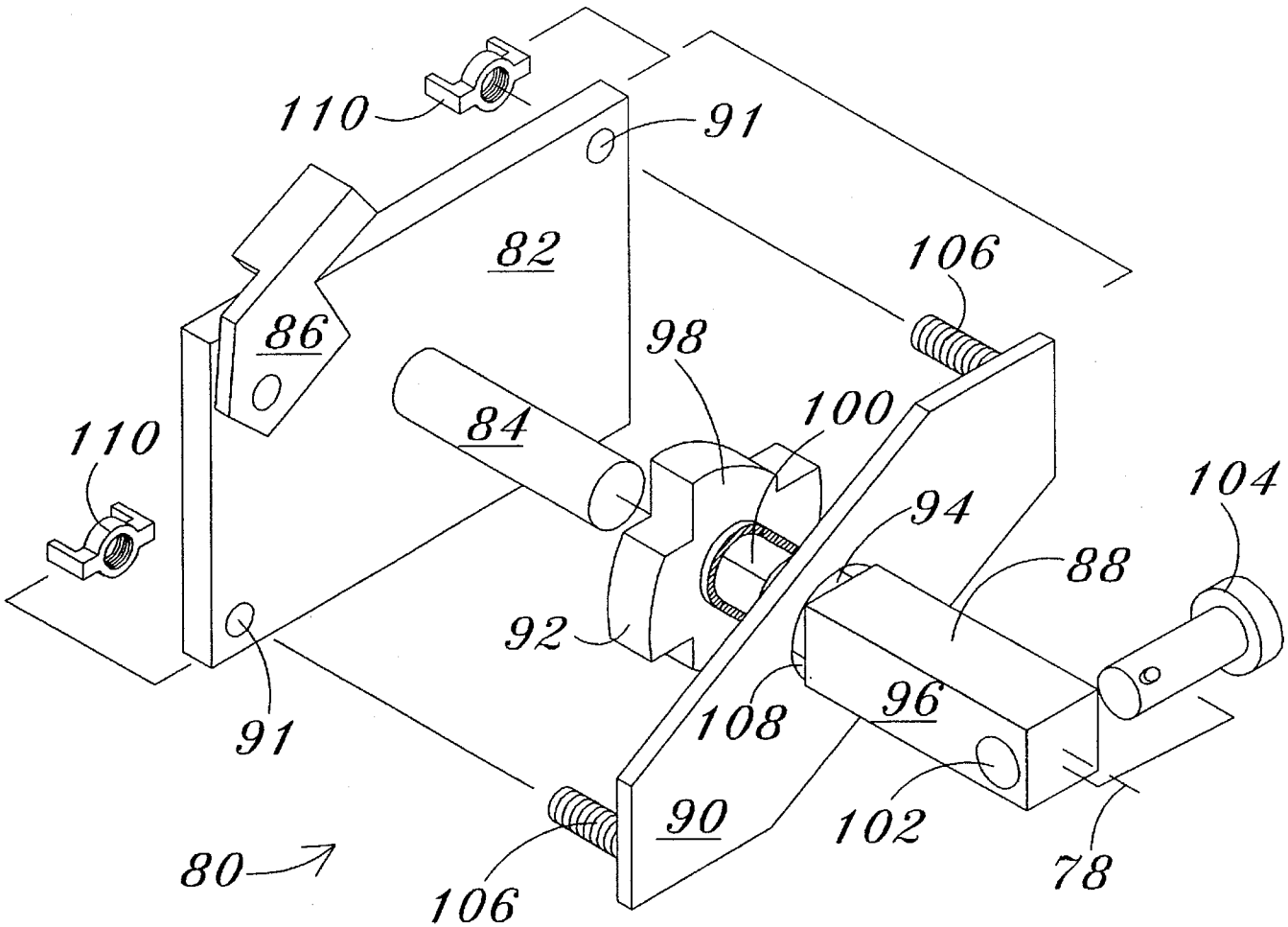
FIG. 4 is an exploded isometric view of the primary reel ratchet-brake subassembly of the preferred embodiment.

As mentioned previously, in the preferred embodiment 10, each boom assembly 16 includes a primary reel 20 attached to the outside segment 52. As illustrated in FIG. 2, the primary reel 20 is a generally cylindrical structure disposed about a reel axis 78 and connected to the outside segment 52 by a ratchet-brake assembly 80. The ratchet-brake assembly 80 is set forth in detail in the exploded view of FIG. 4, and is shown to include a mounting plate 82 with an integral mounting post 84, a pawl handle 86, a ratchet spindle 88 and a retaining plate 90. The mounting plate 82 is a flat, rigid structure attached to the outside segment 52, and the mounting post 84 extends outward, perpendicularly therefrom. The mounting post 84 is also positioned about the reel axis 78. Situated at opposing ends of the mounting plate 82 are retaining apertures 91 which extend all the way through the mounting plate 82. The ratchet spindle 88 is an integral structure with a circular ratchet wheel portion 92 oriented parallel to the mounting plate 82, a spindle post portion 94 extending outwardly from the ratchet wheel portion 92, and a reel retaining portion 96. The ratchet wheel portion 92 is generally circular in cross section and includes a number of ratchet teeth 98. The spindle post portion 94 has a long, cylindrical shape. The reel retaining portion 96 has a long, rectangular solid shape with a square cross sectional aspect. As is shown in FIG. 4, the diameter of the ratchet wheel portion 92 is substantially larger than the cross sectional aspects of the spindle post portion 94 and the reel retaining portion 96. A centrally disposed insertion aperture 100 extends through the ratchet wheel portion 92 and into the spindle post portion 94. The insertion aperture 100 receives the mounting post 84 allowing the ratchet spindle 88 to rotate about the mounting post 84, and correspondingly, the reel axis 78. The reel retaining portion 96 has a rectangular solid shape with a pin aperture 102 extending therethrough. The pin aperture 102 receives a locking pin 104 at an orientation transverse to the reel axis 78.

Referring again to FIG. 4, it is shown that the retaining plate 90 of the preferred embodiment 10, is disposed parallel to the mounting plate 82, and includes two threaded tightening posts 106 and a centrally positioned spindle aperture 108. The spindle aperture 108 is large enough to receive the reel retaining portion 96 and the spindle post portion 94, but is smaller than the ratchet wheel portion 92. The retaining plate 90 is positioned adjacent to the mounting plate 82 with the tightening posts 106 extending through the retaining apertures 91. When assembled, the ratchet wheel portion 92 is sandwiched between the mounting plate 82 and the retaining plate 90 with the spindle post portion 94 and reel retaining portion 96 extending outward from the spindle aperture 108. As shown in the figure, each tightening post 106 receives a tightening nut 110 and can be tightened to force the retaining plate 90 against the ratchet wheel portion 92, providing a drag brake for the ratchet spindle 88.

In the preferred embodiment 10, rotational control of the ratchet spindle 88 is provided by the pawl handle 86 which is pivotally attached to the mounting plate 82 and moves between a "free" position and a "engage" position. In the engage position the pawl handle 86 engages the ratchet teeth 98 and prevents the ratchet spindle 88 from moving in one rotational direction (i.e. clockwise or counter clockwise). In the free position, the pawl handle 86 is positioned above the ratchet teeth 98, allowing the ratchet spindle to move freely. In the preferred embodiment 10, as shown in FIG. 4, gravity forces the pawl handle 86 to naturally fall into the engage position.

Figure 5:
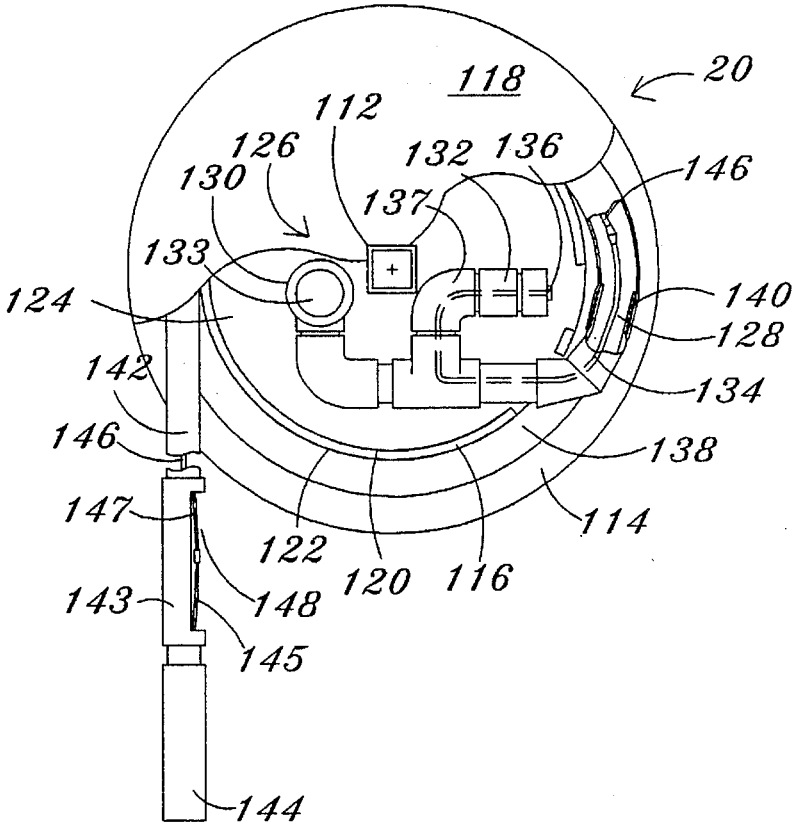
FIG. 5 is a rear, partial cross sectional view of the removable and reversible primary reel of the present invention.

The manner in which the primary reel 20 is mounted to the ratchet brake assembly 80, in the preferred embodiment 10, is best illustrated by referring to FIGS. 1 and 5. As shown in FIG. 5, each primary reel 20 includes a centrally disposed securing aperture 112 having a square cross sectional aspect. The size and the shape of the securing aperture 112 allows it to snugly receive the reel retaining portion 96 of the ratchet spindle 88. Once the primary reel 20 is properly positioned on the reel retaining portion 96, the locking pin 104 is inserted into the pin aperture 102, as shown in FIG. 1. Once the locking 104 pin is inserted, it prevents the primary reel 20 from slipping off the ratchet spindle 88, while at the same time, allows the primary reel 20 to be quickly and easily removed from the ratchet brake assembly 80.

The primary reel 20 of the preferred embodiment 10 is set forth in detail in both the top view of FIG. 2 and the partial cross sectional view of FIG. 5. The primary reel 20 includes an outer rim 114, a hose winding drum 116, and an inner rim 118. The inner and outer rims (114 and 118) are both vertically disposed, generally circular shapes, that are joined by the hose winding drum 116. The hose winding drum 116, as shown in FIG. 5, is a hollow, annular structure, with a cross sectional diameter that is smaller than the size of the rims (114 and 118). The hose winding dram 116 is shown to include inner drum surface 120 and an outer drum surface 122. The inner drum surface 120 defines a drum interior 124. Set within the drum interior 124 is a plumbing tree 126. In the preferred embodiment 10, the plumbing tree 126 is a hollow structure formed by a series of pipe segments that includes a tree fluid input 128, two tree fluid outputs 130 and an electrical input 132. The tree fluid input 128 is a typical hose barb, and extends from within the drum interior 124, disposed at a tangent to the outer drum surface 122. The tree fluid output 130 is formed by a "T" which extends out from within the drum interior 124, perpendicularly to the inner rim 118, and directs fluid to output fittings 133 on both sides of the primary reel 20. These fluid output fittings 133 are commercial fittings which allow for the quick attachment and detachment of various hoses and also accept fluid blocking devices in the form of caps and plugs which readily mate with the commercial fittings to prevent water from exiting the fluid output fitting 133 during rotation of the primary reel 118. The electrical input 132 is coupled to a plumbing tree power cord 134 that is disposed within the plumbing tree 126 and runs from the electrical input 132, of the tree fluid input 128. The electrical input 132 is built by adding electrical components to a ninety degree elbow fitting 137 which is threaded to the plumbing tree 126 but left loose enough so that it can be rotated away from alignment with the tree 126 in order to swing the electrical input 132 to face either side of the primary reel 20.

Each primary reel 20 is both removable and reversible as a result of three important capabilities. First, electrical power can be supplied to the reel from either side via the movable electrical input 132. Second, effluent water can exit the reel from either side via the fluid output fittings 130. Third, the securing aperture 112 in the center of the primary reel is of uniform shape and will accept the ratchet spindle 88 from either side. Primary reels 20 are built to a standard pattern, yet remain entirely interchangeable and can be mounted on either the left boom 16A or the right boom 16B Referring once again to FIG. 1 and 5, it is shown that a pump hose 138 is depicted as wound around the outer drum surface 122. As set forth in FIG. 5, the pump hose 138 includes a plumbing tree attachment end 140 and a pump attachment end 142. The plumbing tree attachment end 140 is fitted to the tree fluid input 128. The pump attachment end 142 of the pump hose 138 is fitted to the top of a pump-to-hose adapter 143, which in turn, is connected to a pump 144. Extending from the pump 144 is a pump electrical supply cord 145. The pump-to-hose adapter 143 routes a power cord 146 out of the inside of the pump hose 138 and through a water tight fitting to a submersible electrical connector 147 which rests in a protective pocket 148 on the outside of the adapter 143, and is connected to the pump electrical supply cord 145.

Having separated fluid and power conduits from each other and routed the power cord 146 from the interior fluid passage inside of the pump hose 138 to the outside of the pump 144, the pump-to-hose adapter 143 itself is a hollow structure, and serves as a rigid fluid passage through which fluids are passed by pumping action of the pump 144 up into the pump hose 138. The adapter 143 both connects the pump hose 138 to the pump 144 and also provides for the easy separation and reconnection of different types and sizes of interchangeable pumps and various extension devices, which shall be discussed at a later time herein. The fluid connection is made via a readily separable female water connection on the bottom of the pump-to-hose adapter 143 which corresponds to a readily separable male water connection mounted on the top of all interchangeable pumps 144 and on the top of all extensions and submergence devices.

The pump-to-hose adapter 143 is constructed to standardized dimensions to insure that it is able to complete its intended function of connecting the pump hose 138 to any given pump 144.

Electrical connection to the pump 144 is accomplished by connecting the submersible electrical connector 147 to the submersible pump electrical supply cord 145. Electrical power can then be provided to the pump 144 by the pump power cord 146, which begins at the electrical input connector 132 and runs through the plumbing tree 126, through the pump hose 138, into and out of the pump-to-hose adapter 143, through the submersible electrical connector 147, and into the pump electrical supply cord 145. The connection between the submersible electrical connector 147 and the pump electrical supply cord occurs within the protective pocket 148 on the outside of the pump-to-hose adapter 143. This shelters the relatively soft and fragile connection from binding, snagging and abrading against the inside surface of a well 149 as the pump-to-hose adapter 143 is raised and lowered.

In operation, the boom assembly 16 is pivoted to position the pump 144 over the well 149 and the primary reel 20 is rotated about the reel axis 78 so as to unwind the pump hose 138 from the hose winding drum 116, and allow the pump 144, to descend into the well 149, as shown in FIG. 1.

While the preferred embodiment 10 illustrates a ratchet-brake assembly 80 associated with the primary reel 20, one skilled in art would recognize that a number of variations on the primary reel 20 are possible. Just a few of the possible variations would be to equip the primary reel with a rear reduction assembly, or pulley attachment to assist in raising and lowering the pump 144, pump-to-hose adapter 143 and hose 138. The present invention could also be equipped with an auxiliary winch to aid in lowering and raising operations. The use of a winch is particularly helpful if attached to the pump-to-hose adapter 143 to prevent excess loading weight from damaging the hose 138. Such a winch could be either mounted to boom assembly 16, or deployed alone.

Figure 6:
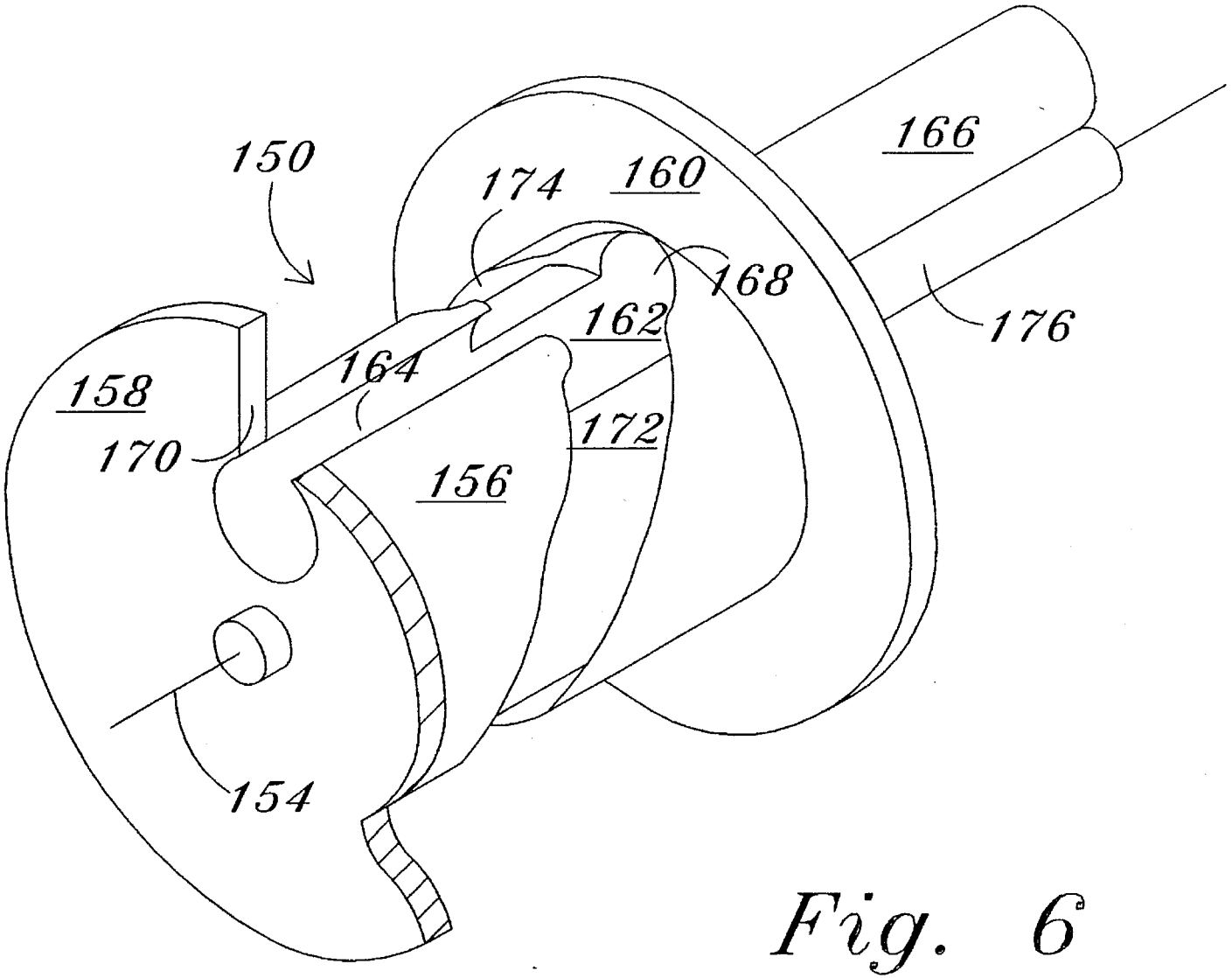
FIG. 6 is an isometric, partial cross sectional view of the take up reel of the preferred embodiment.

A primary element of the present invention is the take up reel assembly 18. As shown in FIG. 1, in the preferred embodiment 10, the take up reel assembly 18 is positioned between the boom assemblies 16 and includes a take up reel 150 that is mounted in a rotating manner to a reel arm 152. The take up reel 150 is illustrated in detail in FIG. 6 and is shown to be a generally cylindrical structure, disposed about a take up axis 154, and includes a winding surface 156, a front lip 158, and a rear lip 160. Set within the winding surface 156, and projecting rearward of the rear lip 160, is a pump holster 162. The pump holster 162 is a long, cylindrical structure disposed parallel to, and radially offset from, the take up reel axis 154, and includes an insertion portion 164 and a cleaning portion 166. The insertion portion 164 runs from the front lip 158 to the rear lip 160, opening into the front lip 158 and the winding surface 156. The cleaning portion 166 is the portion of the pump holster 162 that projects rearward of the rear lip 160, and is an entirely closed structure except for a pump insertion aperture 168 set within the rear lip 160. The insertion aperture 168 joins the insertion portion 164 to the cleaning portion 166. The front lip 158 includes an insertion cut 170 running in a radial manner with respect to the take up reel axis 154 from the insertion portion 164 to an outward edge of the front lip 158. As best illustrated in FIG. 6, set within the winding surface 156 are a clockwise hose bend channel 172 and a counter clockwise hose bend channel 174. The hose bend channels (172 and 174) both intersect the pump holster 162 at a position proximate the pump insertion aperture 168, and curve away from the pump holster 162 toward the front lip 158 in a radial manner with respect to the take up reel axis 154. The clockwise hose bend channel 172 curves away from the pump holster 162 in a generally clockwise direction along the winding surface 156. Correspondingly, the counterclockwise hose bend channel 174 mirrors the clockwise hose bend channel 172, curving away from the pump holster 162 in the counterclockwise direction.

Figure 7:
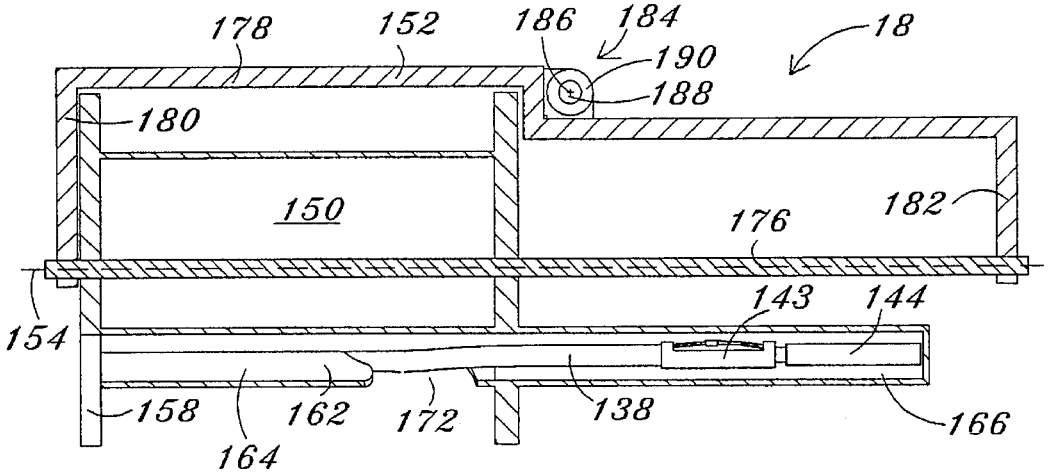
FIG. 7 is a side cross sectional view of the take up reel assembly disposed in a horizontal tilt position.
Figure 8:
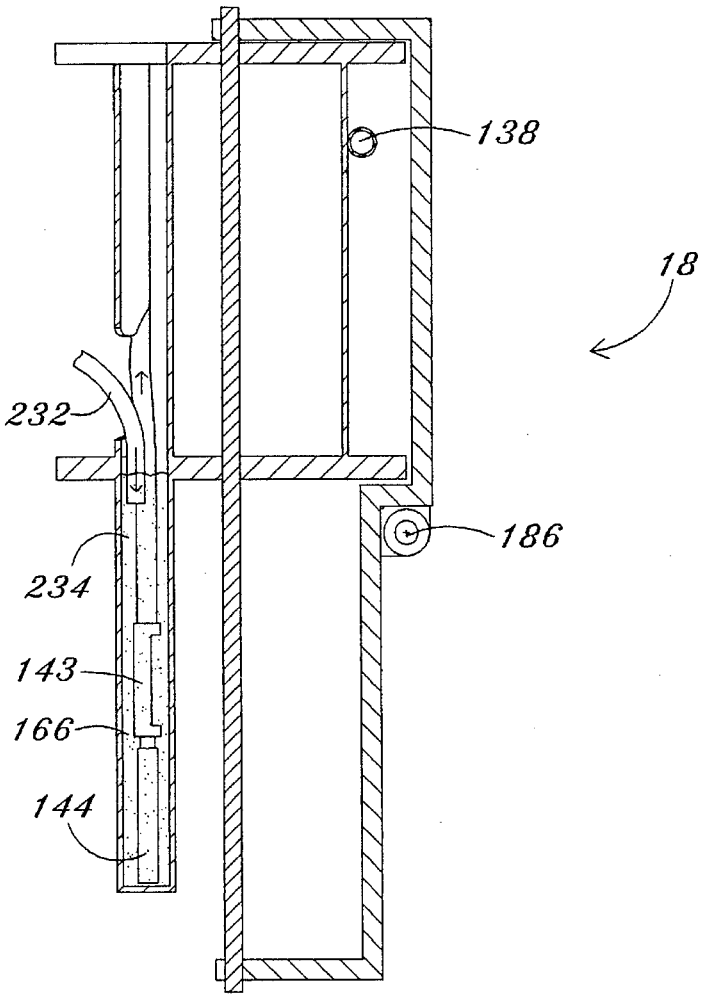
FIG. 8 is a side cross sectional view of the take up reel assembly disposed in a vertical tilt position.

As mentioned previously, the take up reel 150 is secured to, and rotates within the reel arm 152. As is best illustrated in FIG. 7, in the preferred embodiment 10, the reel arm 152 is an integral structure that includes a rigid pivot plate 178, a first axle leg 180 and a second axle leg 182. The pivot plate 178 is parallel to, and offset from the central turning axle 176 of the take up reel assembly 18. As shown in the figure the first axle leg 180 extends away from the pivot plate 178 and is adjacent to the front lip 158. Similarly, the second axle leg 182 extends away from the pivot plate 178 adjacent to the cleaning portion 166. Both axle legs (180 and 182) rotatively engage the turning axle 176 to allow the take up reel 150 to turn within the reel arm 152. The reel arm 152 also includes a tilting assembly 184 that enables the entire take up reel assembly 18 to tilt about a tilt axis 186 that is perpendicular to the take up reel axis 154. As best illustrated in FIG. 2, in the preferred embodiment 10, the tilting assembly 186 includes a tilting bar 188 and a pair of tilt hinges 190. The tilting bar 188 is secured between the cabinet assemblies 26, and passes through the tilting hinges 190, which are attached to the pivot plate 178. A comparison of FIGS. 7 and 8 illustrates the tilting operation of the preferred embodiment 10. In FIG. 7, the take up reel assembly 18 is disposed in a horizontal position. In FIG. 8, the take up reel assembly 18 has been tilted ninety degrees about the tilt axis 186 to position the entire take up reel assembly 18 in a vertical orientation.

Referring once again to FIG. 7, in the preferred embodiment 10, the pump holster 162 is designed to receive the pump 144, the pump-to-hose adapter 143, and a small amount of pump hose 138. The pump 144 and the pump-to-hose adapter 143 comprise a semi rigid assembly which is inserted into the pump holster 162 along with a foot or so of pump hose 138 which is attached to the upper end of the adapter 143. This assembly of connected components is pushed into the pump holster tube 162 as far as it will go, which places the pump 144 and the adapter 143 in the cleaning portion 166 and leaves a small amount of pump hose 138 in the insertion portion 164 of the pump holster 162. The take up reel 150 can then be rotated, and the pump hose 138 guided into one of the hose bend channels (172 and 174), depending upon the direction the take up reel 150 is rotated. As is best illustrated in FIG. 2, both the hose bend channels ( 172 and 174) have a winding radius 192 that forces a certain degree of curvature on the portion of the pump hose 138 set therein. In the preferred embodiment 10, the winding radius 192 is designed to be large enough to avoid imparting too sharp a bend to the pump hose 138, such as would result in damage to the pump hose 138. Once the pump hose 138 is successfully fitted into one of the hose bend channels (172 and 174), the remainder of the pump hose 138 can be off loaded from the primary reel 20 onto the take up reel 18. This arrangement is particularly useful for cleaning the external surface of the pump hose 138. As illustrated in FIG. 2, an external hose cleaning apparatus 194 can be positioned between the primary reel 20 and the take up reel 18 with the pump hose 138 running through it. In this manner, the pump hose 138 can be cleaned as it is wound onto the take up reel 18. Such a cleaning procedure will be discussed in greater detail at a later point herein.

Referring once again to FIGS. 1 and 2, in the preferred embodiment 10, the containment sink 22 is provided to catch liquid cleaning materials used on the various components of the present invention 10. The containment sink 22 is disposed below the take up reel 18 and the primary reels 20 and extends the entire width of the pick up truck bed 12 and outward therefrom. As set forth in FIG. 2, the containment sink 22 includes a sink rear wall 196, a sink front wall 198, a first sink side wall 200, a second sink side wall 202, and a sink bottom 204. Set within the sink bottom 204 is a switchable drain 206 that provides two independent drain paths for the containment sink 22. The first drain path leads to an effluent waste fluid tank (not shown), while the second drain path leads to a waste solvent tank (not shown).

Figure 9:
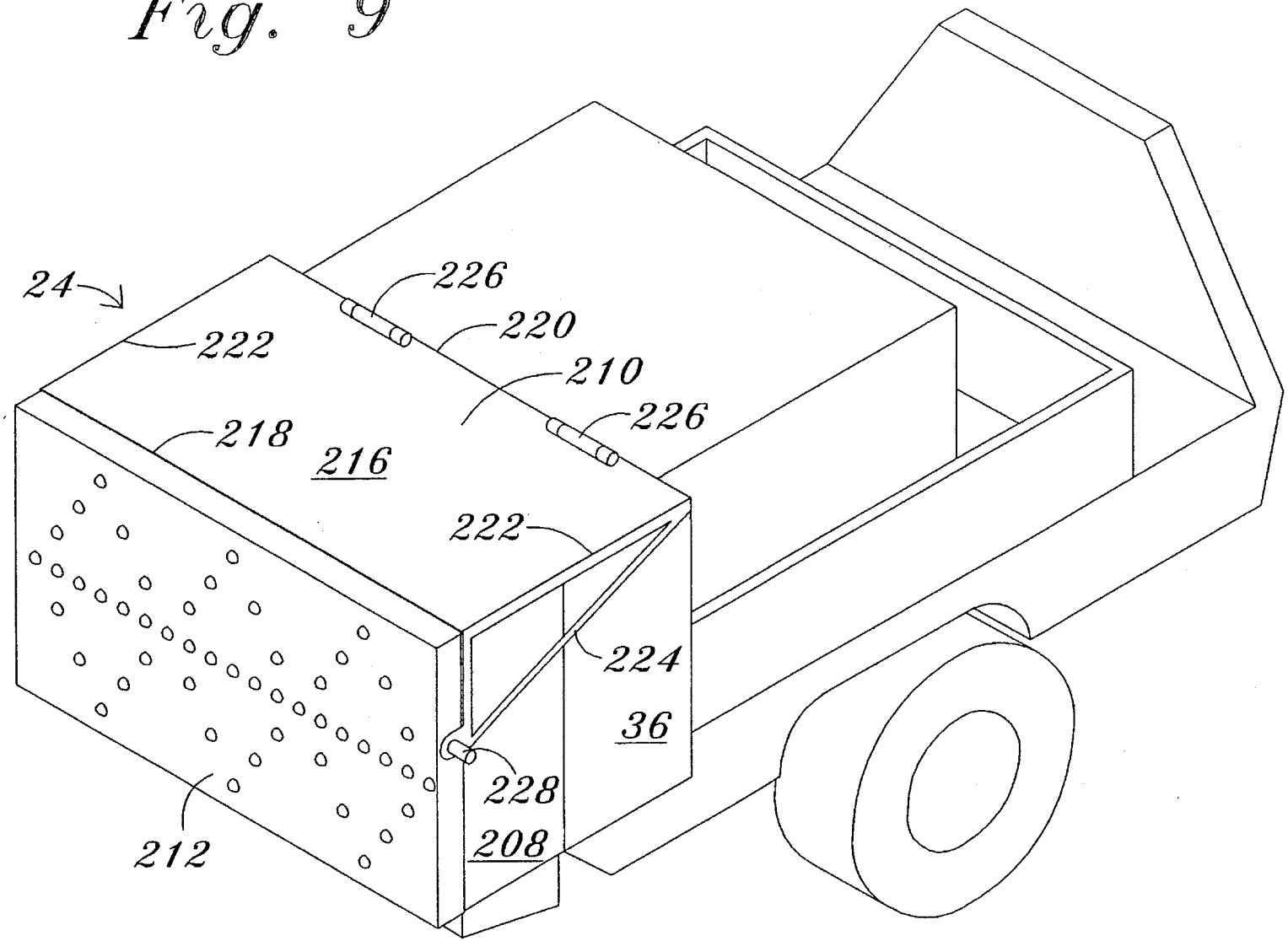
FIG. 9 is an isometric view of the preferred embodiment in the "transport" position.

Set forth in an exploded view in FIG. 1, and in a "transport" position in FIG. 9, is the enclosure assembly 24 of the preferred embodiment 10. As is best shown in FIG. 1, the enclosure assembly 10 includes two side panels 208, a roof panel 210, and a front cover panel 212. Each side panel 208 is a vertically disposed flat, solid member that is attached to one of the cabinet assemblies 26 by a vertical hinge disposed along the edge created by the outside cabinet face 36 and the front cabinet face 30. The roof panel 210 of the preferred embodiment 10, shown in partial cutaway view in FIG. 1, includes a generally rectangular, horizontally disposed top roof portion 216 that is defined by a front roof edge 218, a rear roof edge 220 and two opposing side roof edges 222. A vertically disposed side roof panel portion 224 extends downward from each side roof edge 222. As illustrated in the exploded view of FIG. 1, and in assembled form in FIG. 9, the roof panel 210 is attached to the cabinet tops 38 by a pair of roof panel hinges 226. The cover panel 212 is pivotally attached to the side roof panel portions 224 by two panel pivot hinges 228.

In the preferred embodiment 10, the various components of the present invention can cooperate together to place the present invention 10 in a closed "transport" position, in an open "deployed" position, or in an open "storage" position which is also suitable for decontamination work. The "deployed" position is illustrated in FIGS. 1 and 2 by the right boom 16B, which is shown extended in a position in which the pump 145, adapter 143 and pump hose 138 can be deployed into well 149. The same figures show the left boom 16A folded and locked in the closed "storage" position. When one or both booms 16 are folded into the "storage" position decontamination can be preformed as described in detail herein. The fully closed "transport" position is illustrated in FIG. 9 and characterized by both side panels 208 being swung into a position that is parallel to the outside cabinet face 36 and perpendicular to the front cabinet face 30. In this position both side panels 208 abut the sink side walls 202. Both boom assemblies 16 are folded and secured to the cabinet assemblies 26 in the compact "store" position described above. The roof panel 210 is rotated in a fully downward direction so that the top roof portion 216 is horizontal. It is noted that in this position the side roof panel portions 208 surround the side panels 208, preventing the side panels 208 from moving outward, and the cover panel 212 is vertically disposed, abutting the support beam 28 and the sink front wall 198. In the preferred embodiment 10, the cover panel 212 is equipped with an arrow sign. Once in the "transport" position, all the ground water monitoring components which come in contact with the ground water are entirely enclosed by the enclosure assembly 24. The enclosure assembly 24 is locked to secure all the enclosure components in place and to prevent unauthorized entry or access to the ground water monitoring components.

Having set forth the various components of the preferred embodiment 10 a typical sequence of operations will be set forth. As mentioned previously, the primary purpose of the present invention is to obtain perform ground water monitoring activities which typically include the inspection, gauging, evacuation and sampling of ground water wells 149. The present invention 10 is a mobile pump and hose deployment, decontamination, storage and transport system which is capable of conducting sustained mobile ground water monitoring operations over a wide geographical area. The present invention 10 can safely and cleanly store system components and transport them over long distances without degradation of the "decontaminated" status of components that will enter the ground water. After completing the inspection and gauging of all the wells 149 on the entire site, the ground water monitoring work advances to the stage of first evacuating and then sampling the individual wells. To begin the evacuation and subsequent sampling work on an individual monitoring well, the system 10 is transported to the general vicinity of a ground water well 149, and positioned so that the well 149 is within the arc of either boom assembly 16.

The enclosure assembly 24 is opened to provide access to the primary reels 20 and the take up reel assembly 18. Using the associated segment hinge control lever 76 and boom hinge control lever 68, one of the boom assemblies 16 is maneuvered so as to position its primary reel 16 over the well 149. Once the boom assembly 16 is in position the control levers (68 and 76) are released, locking the boom assembly 16 in position. The primary reel 20 is rotated and the pump 144, pump-to-hose adapter 143, and pump hose 138 are allowed to descend into the well 149. Once the pump 144 is submerged in the well water, it is secured in place by setting the pawl handle 86 on the ratchet brake assembly 80. A ground. Water pumping circuit is created by attaching an effluent hose 230 and an electrical supply cord 231 to the corresponding tree fluid output fitting 130 and the electrical input 132 on the plumbing tree 126 assembly of the primary reel 20. The effluent hose 230 will direct effluent ground water from the well 149 to an effluent storage tank (not shown). This arrangement is illustrated in the top plan view of FIG. 2. The well evacuation process is begun by actuating a switch (not shown) which provides electrical power to the electrical supply extension cord 231 which transmits power to the electrical input 132 and on to the pump 144, as previously described. Ground water is pumped is pumped by the pump 144, through the pump-to-hose adapter 143, the pump hose 138, the plumbing tree 126, the effluent hose 230 and into the effluent water storage tank. Pumping continues until the evacuation process is completed. Evacuation is curtailed by actuating the switch (not shown) which cuts off electrical power to the electrical supply extension cord 231. The electrical supply extension cord 231 is disconnected from the electrical input 132 and stowed out of the way. The effluent hose 230 is removed from the tree fluid output fitting 130 and the fitting is closed with a water blocking device. The pump 144, pump-to-hose adapter 143, and hose 138 are then raised from within the well 149 by rotating the primary reel 20 to turn in the direction which raises the pump 144. The pawl handle 86 acting on the ratchet teeth 98 of the ratchet brake assembly 80 prevents the reel 20 from rotating in the opposite direction. Once the pump hose 138 is fully wound onto the primary reel 20, the boom 16, and all wetted system components are folded into the "store" position over the containment sink 22. Sample collection is then performed.

Once sampling is complete and samples stored, the well 149 is sealed and secured, and the DDST 10 may be moved some distance away from the well 149 to preclude any possibility of any cleaning fluids collecting on or around the top of the well 149 or entering the well 149 and reaching the ground water. At this point decontamination operations are ready to begin.

Decontamination procedures include cleaning all instruments that have come into contact with the ground water. The primary reel 20, the pump 144, the pump-to-hose adapter 143, and the pump hose 138 are all positioned over the containment sink 22 ready to be decontaminated. The pawl handle 86 is moved out of engagement with the ratchet teeth 98 of the ratchet brake assembly 80 in order to allow the primary reel 20 to rotate freely in either the clockwise or counter clockwise direction. Referring again to FIG. 7, the pump 144 and pump-to-hose adapter 143 are aligned with, and then slid into the pump holster 162, entering first the insertion portion 164 and then passing all the way to into the cleaning portion 166. The pump hose 138, which remains attached to the pump-to-hose adapter 143, is fitted into one of the hose bend channels (172 and 174) as shown in FIG. 2. One of several external hose cleaning devices 194 can be situated between the primary reel 20 and the take up reel assembly 18. All these devices have an open side covered by a spring loaded access door which allow each device to be readily opened and fitted over the pump hose 138, even when the pump hose 138 is wound between the primary reel 20 and the take up reel assembly 18. The take up reel 150 is rotated within the reel arm 152 and the pump hose 138 is drawn through the external hose cleaning device 194 as it is wound onto the take up reel 150. The portion of the pump hose 138 that is not drawn through the external hose cleaning device 194, and the primary reel 20 are then manually cleaned. If desired, the primary reel 20 can be rotated and the pump hose 138 drawn back through the external cleaning device 194 (or a second, different cleaning device) as it is wound back onto the primary reel 20. This process, using any of several different devices to clean all of the hose 138 or any selected portion of the hose 138 can be repeated any number of times to obtain a thoroughly decontaminated hose 138, regardless of the hose material of construction. However, in cases where there is insufficient time or cleaning materials to remove especially severe contamination from a particular hose 138, it may be preferable to simply remove that primary reel 20 which contains the contaminated components and replace it with another primary reel 20 which has clean components which will allow productive work to be resumed. The heavily contaminated components can be cleaned at another location when time and materials are available.

As shown in FIG. 8, in the preferred embodiment 10, the cleaning procedure continues by tilting the take up reel assembly 18 into the vertical position. At this time, two water blocking devices which prevent water from flowing from the double tree fluid output fittings 130 can be removed, and one end of a recirculation hose 232 is attached to the unblocked tree fluid output fitting 130. The other end of the recirculation hose 232 is routed into, and secured to the cleaning portion 166 so that it will direct fluid into the cleaning portion 166, which contains the pump 144 and the pump-to-hose adapter 143. This arrangement is illustrated in FIG. 8, and is shown to create a recirculation loop that assists in cleaning the external surface of the pump 144, the pump-to-hose adapter 143, and a small portion of the pump hose 138 that is close to the pump-to-hose adapter 143. More importantly, the recirculation loop enables the internal surface of the pump 144, the pump-to-hose adapter 143, pump hose 138, tree 126 and recirculation hose 232 to be thoroughly cleaned.

With the take up reel assembly 18 tilted into the vertical position, a cleaning fluid 234 is added to the cleaning portion 166 of the pump holster robe 162 until the cleaning portion 166 is full. A switch (not shown) is mined on to provide electrical power to the pump 144 as described above. The cleaning fluid 234 is then pumped by the pump 144, through the pump-to-hose adapter 143, through the pump hose 138, through the tree fluid input 128, out of the tree fluid output 130, through the recirculating hose 232 and back into the cleaning portion 166, where the recirculation cycle begins again. The direction of the cleaning fluid 234 is fancifully designated by arrows in FIG. 8. To dispense with the cleaning fluid 234 in order to repeat the process, or proceed to the next cleaning step, the power is switched off to stop the pump 144 and the take up reel assembly 18 is tilted down into the horizontal position, allowing the used cleaning fluid 234 to drain into the containment sink 22, where it drains into a sump (not shown) and is pumped into the effluent water containment tank (not shown.) This recirculation procedure can be repeated any number of times to remove contaminants from the inside of surfaces of the DDST 10 components.

In those cases where a specific cleaning protocol includes a requirement to rinse various components with solvent, it is possible to do this by using the switchable drain 206 to allow excess solvent to drain into the waste solvent tank (not shown). The switchable drain 206 is then returned to the normal effluent water handling configuration.

Figure 10A:
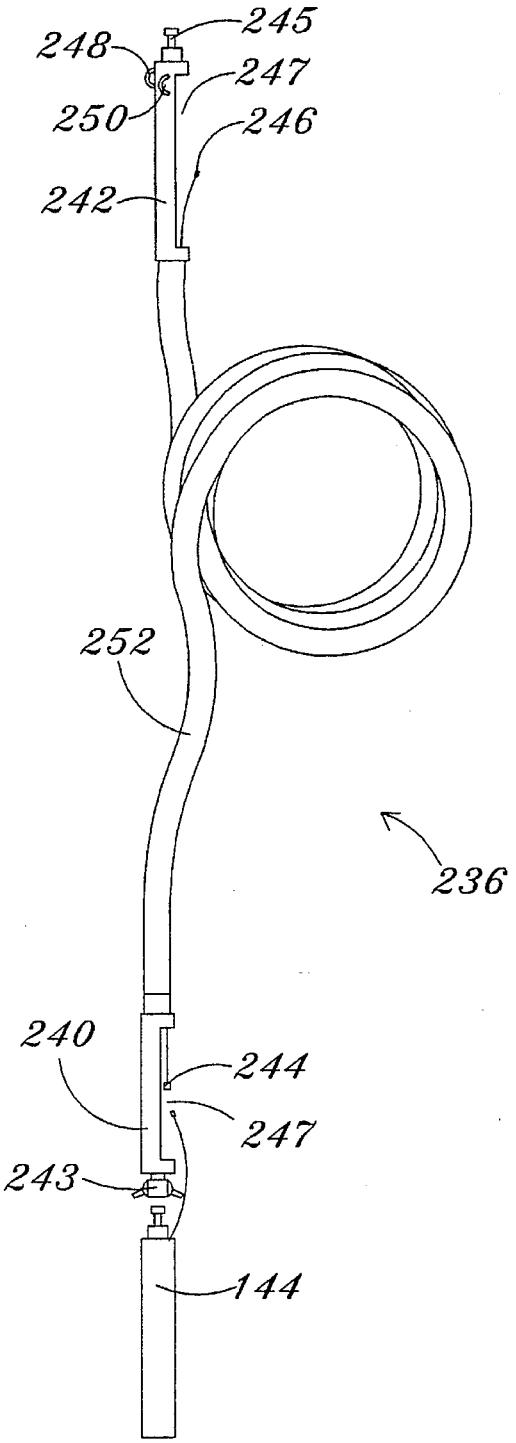
FIGS. 10*a* and 10*b* are a side plan views of two extension devices of the preferred embodiment.
Figure 10B:
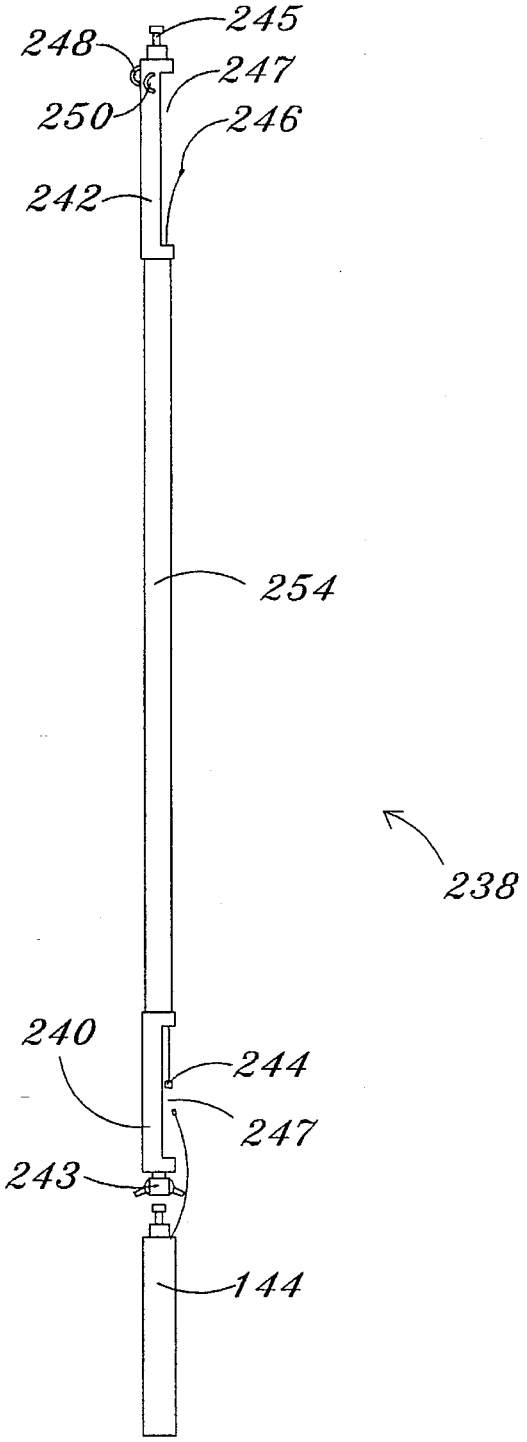

FIGS. 10*a* and 10*b* illustrates two variations on extension devices used in the present invention 10. Due to administrative limitations on the types of materials that may be used to evacuate a well 149, the potential undesirable adsorption and/or absorption effects of some pump hose 138, or cleaning limitations presented by some pump hose 138 materials, it is preferable to evacuate some wells without having to submerge the pump hose 138 imo the well 149. This can be difficult due to the relatively short length of the pump-to-hose adapter 143 and the pump 144. To overcome this problem the present invention 10 includes a flexible extension device 236, set forth in FIG. 10*a*, and a rigid extension device 238, set forth in FIG. 10*b*. Both extension devices (236 and 238) include an extension pump attachment end 240 and an extension adapter attachment end 242. Both extension attachment ends (240 and 242) are composed of stainless steel, in the preferred embodiment 10 As is illustrated in the figures, the extension pump attachment end 240 is adapted to receive the pump 144 and includes a pump fluid coupling 243 and an external pump electrical coupling 244. In a similar manner, the extension adapter attachment end 242 is adapted to receive the pump-to-hose adapter 143, and includes an adapter fluid coupling 245 and an external adapter electrical coupling 246. Like the connection between the pump-to-hose adapter 143 and the pump 144, the electrical connections of the extension devices (236 and 238) are set within extension protective pockets 247. Both extension devices (236 and 238) also each include a sounder extension lug 248 and a auxiliary extension lug 250. The sounder extension lug 248 serves as an attachment point for a sounder (not shown) that will provide a signal to the operator when it contacts water. This ensures none of the pump hose 138 will be submerged during an evacuation procedure. The auxiliary extension lug 250, in the preferred embodiment 10, serves as an attachment point for a supplementary lifting apparatus which can assist is raising and/or lowering the extension devices (236 and 238). The primary difference between the rigid extension device 236 and the flexible extension device 236, is that, in the preferred embodiment 10, the latter includes a flexible central portion 252 composed of pinched stainless steel, while former includes a rigid central portion 254, composed of stainless steel. The central portions (252 and 254) and the extension attachment ends (240 and 242) are all hollow members forming a fluid path between the pump 144 and the pump-to-hose adapter 143 In addition, the central portions (252 and 254) include an insulated electrical path to carry electricity between the extension electrical couplings (244 and 246). Stainless steel is used as the material of construction for the extension devices (236 and 238) as it is acceptable according to administrative regulations and is also easily decontaminated.

Figure 11A:
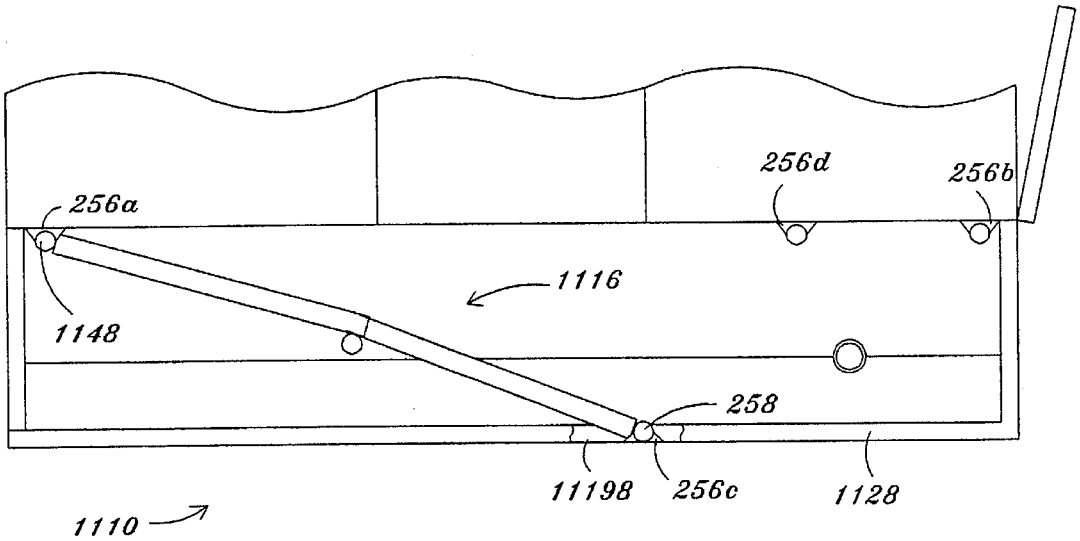
FIGS. 11*a* and 11*b* are top plan views of an alternate embodiment of the present invention.
Figure 11B:
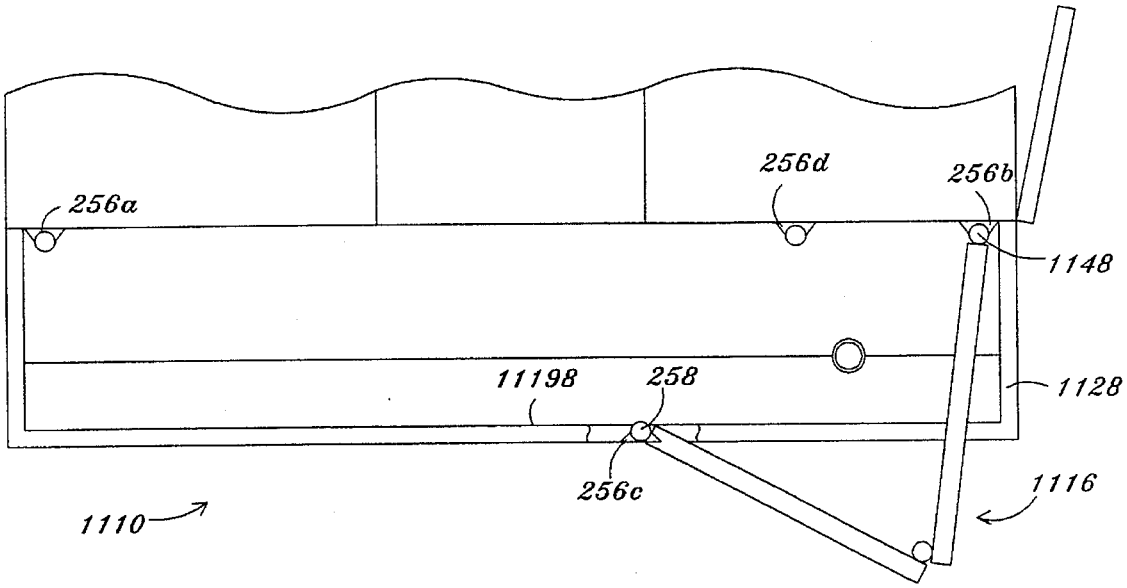

An alternate embodiment of the present invention is illustrated in the top plan views of FIGS. 11*a* and 11*b*. The alternative embodiment is, in many respects, similar to the preferred embodiment 10 illustrated in the other figures. To this end, components which are identical to those appearing in the preferred embodiment 10 will be referred to by reference numbers incorporating the original reference with an initial digit 11. As illustrated in FIGS. 11*a* and 11*b* in the alternate embodiment 1110 is equipped with a boom assembly 1116, and differs from the preferred embodiment 10, in that the system 1110 includes a number of hinge interlocks 256 which allow a hinge to be secured or removed therefrom. As illustrated in FIG. 11*a*, a boom hinge 1148 is secured to the cabinet assembly 1126 by a first hinge interlock 256*a*, and the distal end 1160 of the outside segment 1152 includes a distal hinge 258. In the alternate embodiment 1110 the boom assembly 1116 can be "walked" over from the first detachable interlock 256*a* to a second hinge interlock 256*b* by way of a temporary hinge interlock 256*c* disposed between the support beam 1128 and the sink front wall 11198. The procedure is illustrated in FIGS. 11*a* and 11*b*. The boom assembly 1116 is maneuvered until the distal hinge 258 is secured in the temporary hinge interlock 256*c*. The boom hinge 1148 is then removed from the first hinge interlock 256*a* and the entire boom assembly 1116 pivoted about the distal hinge 258. The boom hinge 1148 is then maneuvered into, and secured to the second hinge interlock 256*b*. The distal hinge 258 is released from the temporary hinge interlock 256*c*, and the boom assembly 16 is now ready for use. The above procedure also applied to relocating the boom 16 on a fourth hinge interlock located at 256*d*. The alternative embodiment 1110 reduces the weight and the cost of the system by eliminating the need for a second boom assembly 16 and a second primary reel 20.

Figure 12A:
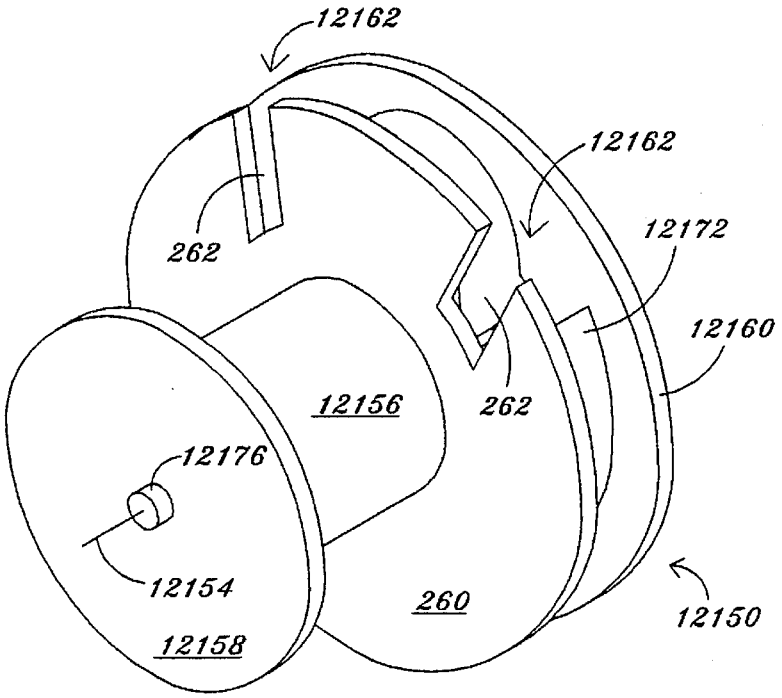
FIGS. 12*a* and 12*b* are isometric views of the take up reel of a second alternate embodiment of the preferred invention.
Figure 12B:
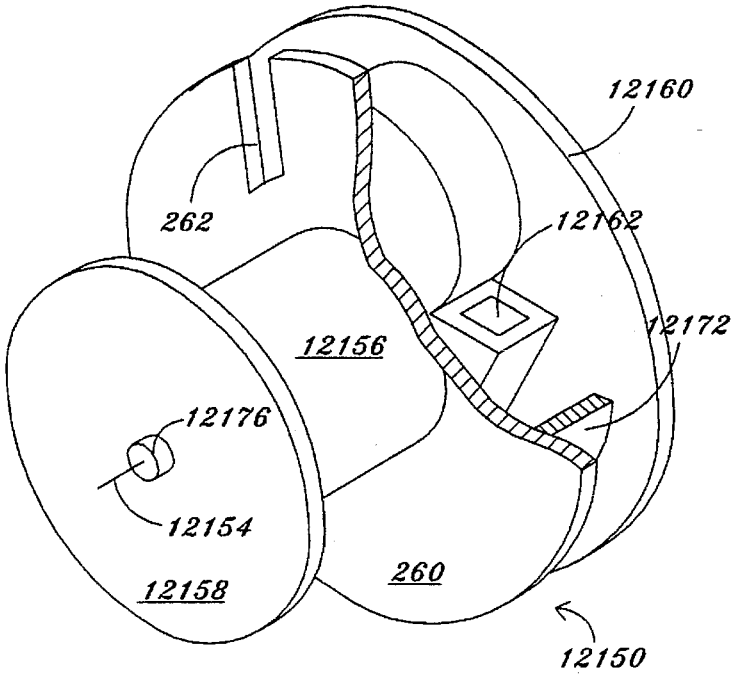

A second alternate embodiment is illustrated in FIGS. 12*a* and 12*b*. The second alternate embodiment is identical the preferred embodiment 10 except in the design of the take up reel. As in the description of the alternate embodiment 1110, components which are identical to those appearing in the preferred embodiment 10 will be referred to by reference numbers incorporating the original reference with an initial digit 12. The take up reel 12150 of the second alternate embodiment is illustrated in an isometric view, and a partially cut away isometric view in FIGS. 12*a* and 12*b*, respectively. The take up reel 1250 rotates about a take reel axis 12154 by way of a turning axle 12176. The take up reel includes a front lip 12158, area flip 12160, and a pump holster lip 260. A winding surface 12156 is disposed between the front lip 12158 and the pump holster lip 260. Set between the pump holster lip 260 and the rear lip 12160 is the hose bend channel 12172. Unlike the hose bend channels (172 and 174) of the preferred embodiment 10, the hose bend channel 12172 of the second alternate embodiment 1210 is a simple radial channel. Set into the hose bend channel 12172 channel are two vertically disposed pump holsters 12162. Corresponding to each pump holster 12162 are two pump hose cuts 262 extending into the holster lip 260. The pump holsters 12162 of the second alternate embodiment 1210, like that of the preferred embodiment 10, are designed to receive the pump 144. Once the pump 144 is fully inserted into the pump holster 12162, the pump hose 138 can be routed over the hose bend channel 12172, through the pump hose cut 262 and wound onto the winding surface 12156. The operator can continue to wind the hose 138 and proceed as described in the preferred embodiment 10. No pivoting of the take up reel 12150 is required as the take up reel 12150 can be rotated so as to orient the pump holsters 12162 in a generally vertical orientation.

All of the above are only some of the examples of available embodiments of the present invention. Those skilled in the art will readily observe that numerous other modifications and alterations may be made without departing from the spirit and scope of the invention. Accordingly, the above disclosure is not intended as limiting and the appended claims are to be interpreted as encompassing the entire scope of the invention.

INDUSTRIAL APPLICABILITY

The predominant current usage for the present invention 10 is for ground water monitoring. Specifically, the present invention assists in the deployment, decontamination, storage and transport of those pump and hose devices which are used to evacuate wells prior to sample collection as required by regulatory agencies and professional consultants. However, the present invention 10 has broader utility to all aspects of the mobile ground water monitoring field because of the significant improvements it makes in the handling and decontamination, storage and transport. The present invention 10 also provides a simple operating platform which supports the use of relatively small, light and inexpensive extensions and submergence devices which can readily replace conventional components made of unapproved materials with readily cleanable components made of materials approved by the US EPA for use in precisely these sorts of ground water monitoring applications. These extensions and submergence devices are small enough, light enough and inexpensive enough to become part of the standard battery of tools carried on any well equipped sampling vehicle.

The present invention 10 is intended to be a substitute for existing ground water monitoring systems. The areas of basic innovation include improved deployment, decontamination, storage and transport of ground water monitoring equipment including, but not limited to pumps and hoses used in mobile applications. Other improvements are garnered from the reduced weight which allows more of the load carrying capacity of the vehicle to be allocated to carrying loads associated with work being done, rather than carrying just the tools required to perform the work. Avoidance of hydraulic power assistance devices makes the system cleaner, safer and less difficult to clean, maintain and repair. The components are straightforward and intuitive to operate. Being composed of simple components the operation of the system is easy to teach and easy to learn.

The present invention 10 contains and protects system components from contamination. The same locking enclosures protect the equipment from unauthorized handling, pilferage and theft. As a self contained system, the present invention 10 can perform all types of ground water monitoring work including thorough decontamination of all the components in the system in any location and at any time. System efficiency is enhanced by not being dependent on a centralized cleaning location and not having to spend time returning to such a central location after each well is monitored.

The present invention 10 provides a logical and orderly work area for the performance of ground water monitoring, and can be readily adapted to new techniques and new devices.

Since the mobile pump and hose deployment, decontamination, storage and transport system presented here in the present invention 10 may be readily constructed and provides many advantages over the prior art, it is expected that the present invention will be accepted in the industry as a substitute for conventional ground water monitoring systems. For these and other reasons, it is expected that the utility and industrial applicability of the invention will be both significant in scope and long-lasting in duration.

What is claimed is:

1. A ground water monitoring system, comprising:

a rigid support member;

a pump and hose assembly, said pump and hose assembly including a pump unit and a hose;

at least one rotatable take up reel assembly for receiving and winding said pump and hose assembly, said take up reel assembly being attached to said rigid support member, said take up reel assembly including a generally cylindrical winding surface for receiving the hose, and a pump holster for receiving the pump unit, the pump holster being set within the winding surface; and means for rotatable deployment of said pump and hose assembly.

2. The system of claim 1 wherein:

the pump holster includes a cleaning portion, the cleaning portion being a closed structure for containing a cleaning fluid.

3. The system of claim 2 wherein:

said take up reel assembly includes a take up reel axis and a reel pivot assembly, the take up reel assembly pivoting about the reel pivot assembly between a horizontal position and an angled position, the horizontal position being defined by the take up reel axis being substantially horizontally disposed, the angled position being defined by the take up reel axis being inclined with respect to the horizontal position.

4. The system of claim 2 further including:

a recirculation coupling assembly having a coupling input and a coupling output, the coupling input being connected to the hose, and the coupling output being connected to the cleaning portion to create a recirculation path for recirculating the cleaning fluid from the pump unit, through the hose and recirculation coupling assembly, and into the cleaning portion.

5. The system of claim 4 wherein:

the recirculation coupling includes a plumbing tree and a coupling hose, the plumbing tree being a hollow structure having the coupling input and a hose output, the coupling hose having a coupling hose end and the coupling output, the coupling hose end being attached to the hose output.

6. The system of claim 1 wherein:

the hose of said pump and hose assembly includes a hose end section, the pump unit being attached to the hose at the hose end section; and said take up reel assembly further includes at least one hose bend channel for receiving the hose end section when the pump unit is received by the pump holster, the hose bend channel being inset within the winding surface, opening into the pump holster, and having a bend curvature of at least a minimum bend radius, the minimum bend radius being the smallest radius the hose can be curved without damaging the hose.

7. The system of claim 6 wherein:

said take up reel assembly rotates about a take up reel axis and includes a clockwise hose bend channel disposed in a clockwise direction with respect to the take up reel axis, and a counter clockwise hose bend channel disposed in a counterclockwise direction with respect to take up reel axis, the hose bend channels each opening into the pump holster at a same position in the pump holster.

8. The system of claim 1 wherein:

said means for rotatable deployment includes at least one boom assembly.

9. The system of claim 1 wherein:

said take up reel assembly includes a take up reel, the take up reel rotates about a take up reel axis and the pump holster is disposed generally perpendicularly to the take up reel axis within said take up reel.

10. The system of claim 1 wherein:

said primary hose reel assembly includes a lockable ratchet means.

11. A mobile ground water monitoring apparatus, comprising:

a support frame;

at least one boom member, said boom member including an inner boom section and an outer boom section, the inner boom section having a boom attachment end and an opposing first joining end, the boom member being pivotally attached to said support frame at the boom attachment end by a first pivot joint, the outer boom section having a boom distal end and an opposing second joining end, the first and second joining ends being pivotally connected by a second pivot joint, the first and second pivot joints allowing horizontally disposed pivoting of the inner and outer boom sections, the horizontally disposed pivoting of the inner and outer boom sections permitting the boom member to have a compact folded store position and a range of horizontally extended deployment positions, the store position being defined by the inner boom section being pivoted generally parallel and adjacent to said support frame and the outer boom section being pivoted generally parallel and adjacent to said inner boom section;

a pump and hose assembly; and a rotatable primary hose reel assembly mounted on the outer boom section for rotatable deployment of said pump and hose assembly.

12. The system of claim 11 wherein:

the boom distal end includes a removable pivot joint and the first pivot joint of said boom member is a removable pivot joint;

said support frame includes a plurality of pivot joint interlocks for receiving the removable pivot joints of said boom member.

13. The system of claim 11 wherein:

at least one of the pivot joints is a lockable pivot joint.

14. The system of claim 13 wherein:

at least one of the lockable pivot joints is controlled by a control lever having a joint lock position and a joint move position, the joint lock position being defined by the lockable pivot being locked in position, and the joint move position being defined by the lockable pivot joint being free to pivot, the control lever being pretensioned in the joint lock position.

15. The system of claim 13 wherein:

at least one of the lockable pivot joints includes a disk-caliper brake.

16. The system of claim 13 wherein:

at least one of the lockable pivot joints includes a hydraulic piston employing alcohol as a hydraulic fluid.

17. The system of claim 16 further including:

at least one take up reel assembly.

18. A mobile pump and hose deployment, decontamination, storage and transport system, comprising:

an attachment frame;

at least one boom assembly having a primary hose reel thereon, said boom assembly being pivotally attached to said attachment frame, each said boom assembly provided with segments and joints to operate in the same manner as a folding door having at least two hinged door panels, the folding door operation permitting a compact storage position and a range of horizontally extending deployment positions for each said boom assembly thereby;

a pump and hose assembly, said pump and hose assembly including a pump unit and a hose, said pump and hose assembly having interior surfaces, said pump and hose assembly being rotatably deployable via the primary reel; and at least one take up reel assembly for receiving and winding said pump and hose assembly, said take up reel assembly being attached to said attachment frame said take up reel assembly including a generally cylindrical winding surface for receiving the hose, and a pump holster for receiving the pump unit, the pump holster being set within the winding surface.

19. The system of claim 18 further including:

an enclosure structure extending from said attachment frame, said enclosure structure including a first side surface, a second side surface, a top surface and a front surface, said enclosure structure enclosing the boom assembly and the take up reel assembly.

20. The system of claim 18 further including:

an external hose cleaning apparatus interposed between the primary reel and said take up reel.

21. The system of claim 16 further including:

a recirculatory cleaning system connected to the pump holster for cleaning the interior surfaces of the pump and hose assembly.

22. The system of claim 18 further including:

a containment sink disposed below the primary reel and said take up reel.

* * * * *